United States Patent [19]

Vincoli

[11] Patent Number: 4,969,339

[45] Date of Patent: Nov. 13, 1990

[54] YARN FEEDER DEVICE FOR FEEDING YARNS HAVING ELASTIC CHARACTERISTICS FOR A KNITTING MACHINE

[75] Inventor: Armando Vincoli, Brescia, Italy

[73] Assignee: Santoni & C. S.p.A., Brescia, Italy

[21] Appl. No.: 254,051

[22] Filed: Oct. 6, 1988

[30] Foreign Application Priority Data

Oct. 8, 1987 [IT] Italy ..... 22 178 A/87

[51] Int. Cl.[5] ..... D04B 15/50

[52] U.S. Cl. ..... 66/132 R

[58] Field of Search ..... 66/125 R, 132 R

[56] References Cited

U.S. PATENT DOCUMENTS

| | | | |
|---|---|---|---|
| 2,541,192 | 2/1951 | Blake | 66/132 R |
| 3,858,416 | 1/1975 | White et al. | 66/132 R |

FOREIGN PATENT DOCUMENTS

| | | | |
|---|---|---|---|
| 1900722 | 8/1970 | Fed. Rep. of Germany | 66/132 R |
| 745986 | 7/1980 | U.S.S.R. | 66/132 R |
| 1199843 | 12/1985 | U.S.S.R. | 66/132 R |
| 1027912 | 4/1966 | United Kingdom | 66/132 R |
| 1246625 | 9/1971 | United Kingdom | 66/132 R |

*Primary Examiner*—Wm. Carter Reynolds

*Attorney, Agent, or Firm*—Diller, Ramik and Wight

[57] ABSTRACT

A yarn feeder device for feeding yarns having elastic characteristics includes a feeder roll carried by a drive shaft which is journalled for rotation between a pair of shoulders. The feeder roll has a peripheral surface engaged by each peripheral surface of a pair of pressure rolls with yarn being fed tangentially therebetween. A pair of arms is pivoted to one of the shoulders and each arm rotatably carries one of the pressure rolls. A drive wheel is nonrotatably, but axially slidably connected to the drive shaft and is adapted for driving engagement with a rotatable drive disk. The drive wheel is also shiftable by a fork member along the drive shaft to vary the point of driving contact between the drive wheel and the drive shaft to thereby control the speed of the feeder roll. A pair of guide members guide the fork member for guiding movement along a path corresponding to the axial sliding direction of movement of the drive wheel, and a rod in threaded engagement with the fork member is operated by a stepping motor for selectively rotating the threaded rod.

23 Claims, 2 Drawing Sheets

YARN FEEDER DEVICE FOR FEEDING YARNS HAVING ELASTIC CHARACTERISTICS FOR A KNITTING MACHINE

BACKGROUND OF THE INVENTION

The present invention relates to a feeder device for feeding yarns having elastic characteristics for a knitting machine, in particular a hosiery knitting machine.

In the processing of hosiery, in order to give elastic characteristics to the product, it is known to insert an elastic yarn in correspondence of certain stitch courses, with said yarn having elastic characteristics being knitted between the stitch loops. According to the shape of the product, it may become necessary to feed amounts of yarn which are different from course to course, e.g., by progressively decreasing or increasing the amount of yarn fed per each stitch course.

The feeding of a yarn having elastic characteristics is generally carried out by means of a feeder roll, kept pressed against the face of a revolving disk, the revolution speed of which depends on the revolution speed of the machine, with the yarn running between the roll and the disk. In order to control the amount of yarn fed per each unit time, the roll is shifted along the surface of the disk according to a radial direction of the same disk, i.e., parallel to the axis of the roll, so as to vary the peripheral speed of the roll, as well as the radial distance of the yarn from the axis of revolution of the disk, which continues to revolve at a speed derived from the speed of the machine.

Such a feeder device is capable of delivering to the machine one elastic yarn only. In case feeding a plurality of elastic yarns is desired, whether with one elastic yarn feed, or a plurality of elastic yarn feeds, a plurality of devices of this kind have to be provided, with several problems consequently arising.

Besides the problems of overall dimensions and of cost, which are not negligible, the problem exists that a plurality of yarns have to be fed at the same speed and under the same tension, otherways in the finished product more and less tensioned yarns would be contained, with a considerable worsening in product quality. With a plurality of devices of the above stated type, identical conditions of feeding of the respective yarns cannot be secured.

SUMMARY OF THE INVENTION

The main purpose of the present invention is to provide a yarn feeder device for yarns having elastic characteristics, which makes it possible more yarns to be fed under the same conditions as regards feeding speed and yarn tension, so as to secure an evenness in knitting of the various yarns in the end product.

Within the scope of this purpose, the present invention is also aimed at providing a device of the specified type, which has reduced overall dimensions, and is reliable in operation, as well as easily applicable to existing machines.

Furthermore, by means of the device of the present invention, it must be possible to modify the feed conditions as a function of the knitting requirements, anyway securing the uniformity of feeding conditions for the various yarns fed, both in case two yarns are fed, and in case more than two yarns are fed.

In order to achieve the recited purposes, according to the invention a yarn feeder device for feeding yarns having elastic characteristics for knitting machines, and, in particular, for hosiery knitting machines, is proposed, which comprises a feeder roll actuated to revolve at a controlled revolution speed, and feeding the yarn by tangential contact with a revolving countersurface, characterized in that the yarn feeder roll is in tangential contact with at least two yarns in different peripheral positions, and that in these positions respective pressure rolls are positioned, in tangential rolling engagement with the feeder roll.

Advantageously, with a feeder device of this type, each yarn is fed under the same conditions of speed (amount of yarn per each unit time) and of tension, thanks to the tangential contact with the same revolving peripheral surface of the feeder roll. The revolution speed of the feeder roll can be varied as a function of the requirements, so that all of the yarns undergo simultaneously the same change in feeding speed, without any differences relatively to one another. One single device, capable of feeding two or more yarns, involves a reduced manufacturing cost and a limited room requirement, and can be easily installed in any preferred points of the machine, in particular above the machine, or above the plateau of the machine.

The change in feeder roll peripheral speed can be advantageously obtained by means of a stepless speed change unit which is constituted by a revolving disk and a roll into contact with the surface of the disk, and shiftable in the radial direction of the disk, in order to change the roll speed. It should be observed that such a speed change unit, which in the devices of the prior art constitutes the true yarn feeder device, in the present invention is an adjustment device for a separate feeder device, constituted by the single feeder roll, tangentially cooperating with twO or more pressure rolls.

Further details and advantages of the present invention will be more evident from the following disclosure in detail of a form of practical embodiment, preferred but not exclusive of the same invention, illustrated for exemplifying purposes in the hereto attached drawings, wherein:

DESCRIPTION OF THE PREFERRED EMBODIMENTS

Figure 1:
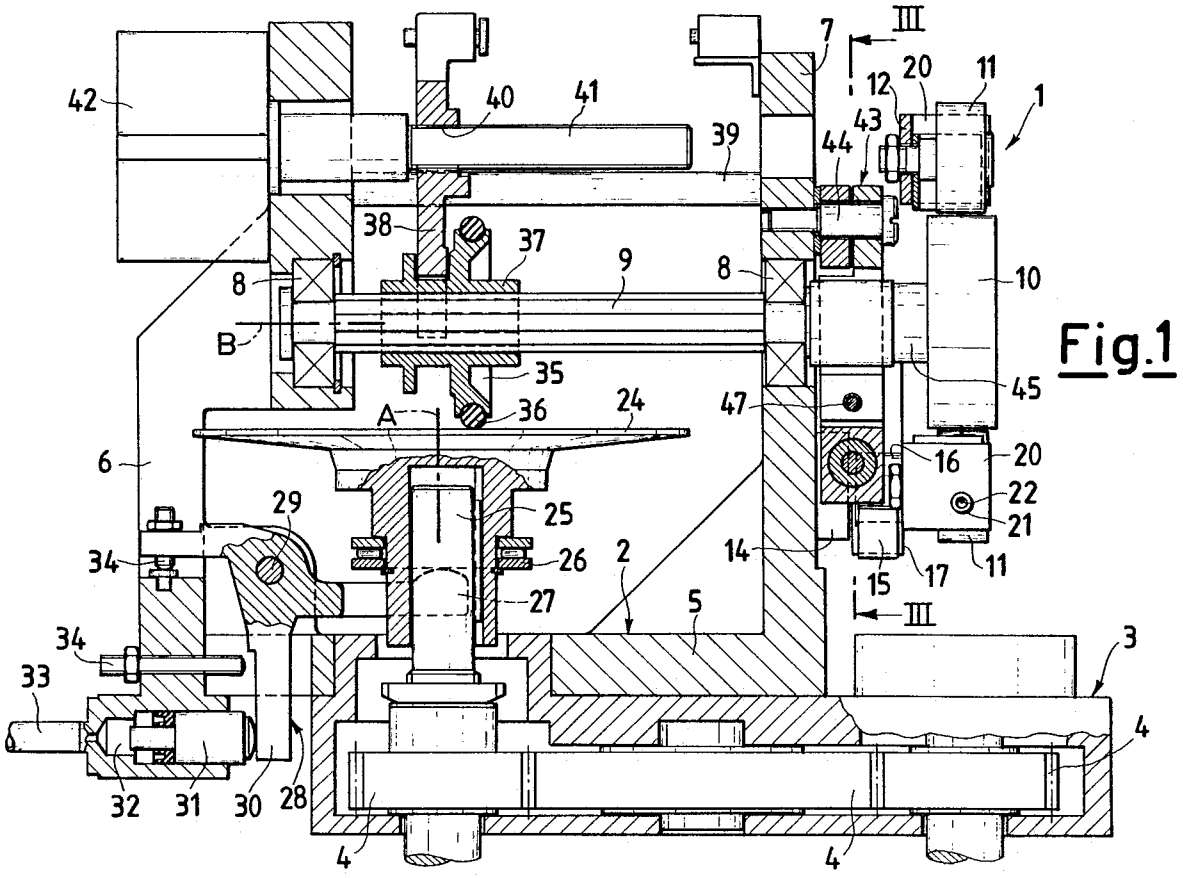
FIG. 1 shows a longitudinal vertical sectional view of a feeder device according to the present invention.
Figure 3:
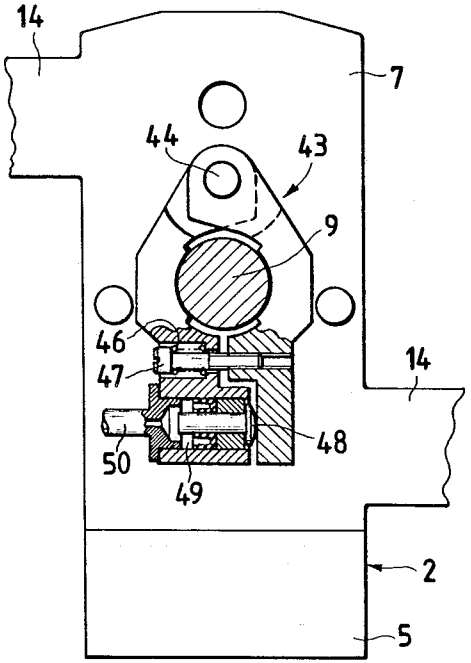
FIG. 3 shows a sectional view of the feeder device according to path III—III of FIG. 1.
Figure 2:
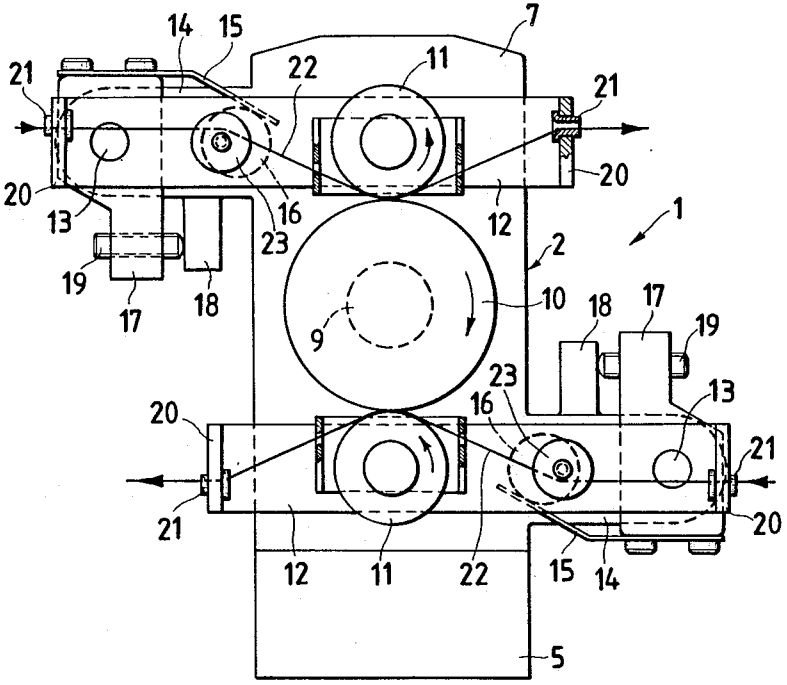
FIG. 2 shows a front view of the feeder device, made looking from the right-hand side of FIG. 1.

A yarn feeder device 1 for yarns having elastic characteristics (e.g., "lastex" yarns), has a support 2 which can be fastened onto a knitting machine, in particular a hosiery knitting machine. In the depicted example, the support 2 is fastened onto the head 3 of a cylinder-plateau machine, of which the gear wheels 4 designed to drive the plateau are schematically shown.

The support 2 has a base 5 from which two mutually spaced-apart shoulders 6 and 7 extend upwards, with said shoulders rotatably bearing, at a certain distance from the base 5, by means of bearings 8, a shaft 9 driving and supporting a feeder roll 10. The shaft 9 is positioned with its axis horizontal, and the roll 10 is installed externally relatively to the shoulders 6 and 7.

With the roll 10, two pressure rolls 11 cooperate under tangential rolling engagement, with said pressure rolls 11 being positioned on diametrically opposite positions of the roll 10, and having their axis parallel to the axis of the roll 10. Each roll 11 is rotatably borne by a respective support arm 12, hinged by means of a pivot 13 to a respective appendix 14 of the shoulder 7. The mutual engagement between each pressure roll 11 and the feeder roll 10 is secured by a respective spring 15, an end of which acts on an appendix 16 of the respective arm 12, with the other end of said spring being fastened onto a block 17 hinged onto the relevant pivot 13, and reacting against a fixed stop 18, with the stop being adjustable in position by means of the adjustment screw 19.

Each arm 12 has two ends 20 bent at a right angle, provided with respective small-size guide bushes 21 for the yarn 22, which, by entering from one side of the arm 12, as shown by the arrows, runs firstly through a disk yarn brake 23 of a per se known type, and then between the feeder roll 10 and the corresponding pressure roll 11, then exiting from the other side of the arm 12. In the present case, the two yarns 22 being fed run in opposite directions.

In order to be able to drive the feeder roll 10 at an adjustable speed, so as to change the speed of feeding of the yarns 22 as a function of the processing requirements, inside the shoulders 6 and 7 a speed adjustment device is provided, which comprises an actuator disk 24 installed with its axis A perpendicular to the axis B of the shaft 9, and keyed to a drive shaft 25 which receives the motion directly from the shaft driving the plateau drive unit, so that the disk 24 constantly revolves at a speed correlated to the speed of revolution of the cylinder and of the plateau of the knitting machine.

The disk 24 can be axially shifted relative to the shaft 25, while maintaining its revolutionary engagement with it, and for this purpose it is supported, with the interposition of a bearing 26, by a fork-shaped end 27 of a bell crank 28, which is hinged onto a fixed axis 29 defined in correspondence of the base 5 of the support 2. The bell crank 28 has another end 30 on which a piston 31 acts, which is slidable inside a seat 32 defined in the support 2 and connected to a source of pressurized fluid, not shown in the figures, through a duct 33. The bell crank 28 is thus movable between an operating position, shown in FIG. 1, in which the piston 31 acts on the bell crank 28 under the action of the pressurized fluid and the bell crank 28 has its forked end 27 in a lifted position, and a resting position, in which this forked end 27 is lowered under the weight of the disk 24 and the piston 31 is retracted in that the pressurized fluid was evacuated from the seat 32. Both bell crank 28 positions are adjustable by means of adjustable stroke limits 34.

In the operating position of the bell crank 28, the upper surface of the disk 24 is in revolutionary engagement with a drive wheel 35, and more precisely with a friction peripheral ring 36 fitted on the drive wheel 35, which is integral for revolution, but is axially shiftable on the shaft 9 which drives and supports the feeder roll 10. For this purpose, the shaft 9 is a splined shaft, geometrically coupled with a corresponding sleeve 37 integrally made as a single piece with the drive wheel 35. The sleeve 37 is engaged with revolutionary-translational engagement by a fork 38, guided on guides 39, fastened between the shoulders 6 and 7 parallelly to the shaft 9, and has a screw-threaded bore 40 in revolutionary-translational engagement with a screwed rod 41, also parallel to the shaft 9. The screwed rod 41 can be driven to rotate by means of a stepper motor 42 fastened onto the shoulder 6.

One will easily understand that, by modifying the axial position of the drive wheel 35 on the shaft 9, i.e., its radial position on the disk 24, the peripheral speed, and therefore the angular speed, of the drive wheel 35, and consequently the revolution speed of the feeder roll 10 is varied, with the revolution speed of the disk 24 remaining constant.

On the shaft 9, on the side of the feeder roll 10, a pincers brake 43 furthermore acts, the shoes of which are hinged onto the shoulder 7 by means of a pivot 44, and act on a cylindrical portion 45 of the shaft 9. The shoes of the pincers brake 43 are kept closed in braking position by a spring 46, acting on one side on one of the pincers shoes, and on the other side on the head of a screw 47 screwed down to the other shoe of the pincers brake 43. The opening of the pincers is pneumatically controlled by means of a piston 48, sliding inside the seat 49 of one of the shoes of the pincers 43, and acting on the other element. The seat 49 is connected to a source of pressurized fluid through a duct 50.

Under operating conditions, the pressurized fluid acts on the pistons 31 and 48, so that the bell crank 28 is in its operating position and the disk 24 is in revolutionary engagement with the drive wheel 35, whilst the brake 43 is released. The shaft 9 revolves, and the feeder roller 10 revolves at a speed determined by the position of the drive wheel 35 on the disk 24.

Under these conditions, both yarns 22, in tangential contact with the same feeder roller 10, are fed exactly at the same speed, and therefore the same amount thereof is fed per each time unit, i.e., both yarns are fed under perfectly identical conditions, with the uniformity of knitting of both yarns in the product being processed being secured. The equality of feed of the one and of the other yarn is anyway secured also in case a change in revolution speed of roll 10 is commanded, inasmuch as the conditions of engagement of the yarns with said roll 10 are at any time the same for both yarns.

When the feed of the elastic yarns has to be discontinued, giving a command for the evacuation of the pressurized fluid from the seats 32 and 49 will suffice, in that the disk 24 will sink instantaneously owing to its own weight, and the drive wheel 35 will disengage from the disk 24, while the spring 46 will cause the shoes of the brake 43 to close, so that the brake will stop instantaneously any further rotation of the feeder roll 10. Also during the stopping step, the yarns 22 are hence subject to same actions by the feeder device.

The change in yarn feed speed can be easily controlled as a function of the requirements, by suitable commands by the stepper motor 42.

One will understand that instead of two yarns 22 only, also more than two yarns can be fed by means of the same feeder roll 10, with the yarns being in tangential contact with the roll in a same number of different peripheral positions, and being pressed against the roll by respective pressure rolls 11.

The device 1 can be easily applied to any knitting machine, without requiring any particular preliminary adaptations of the same knitting machine.

The hereinabove disclosed device can of course be variously modified, without departing from the scope of protection of the instant patent. So, e.g., the adjustment device for the revolution speed of the feeder roll 10 could be absent, in case a variable speed of roll 10 is not required, or this device could be of electronic and not of mechanical character. A same feeder device could feed yarns supplied by a single yarn feed, as well as by a plurality of yarn feeds.

I claim:

1. A yarn feeder device for feeding yarns having elastic characteristics comprising a feeder roll adapted to rotate at a controlled speed, said feeder roll having a peripheral surface, a pair of pressure rolls each having a peripheral surface in opposing contact with said feeder roll peripheral surface, said feeder roll and pressure rolls being rotatable in opposite directions whereby yarn tangentially positioned between each pressure roll peripheral surface and feeder roll surface is fed thereby, a support base having a pair of spaced shoulders, said feeder roll being driven by a drive shaft journalled for rotation by said shoulders, said feeder roller being disposed outboard of one of said shoulders, a pair of arms pivoted to said one shoulder, each arm rotatably carrying one of said pressure rolls, a drive wheel nonrotatably and axially slidably connected to said drive shaft, a rotatable drive disk adapted for driving engagement with said drive wheel whereby rotation of said drive disk is imparted to said drive shaft through said drive wheel, means for selectively positioning said drive wheel along said drive shaft to vary the point of driving contact between the drive wheel and drive shaft and thereby control the speed of said drive shaft and feeder roll, said positioning means including a member having a fork in engagement with said drive wheel, guide means between said shoulders for guiding movement of said member along a path corresponding to the axial sliding direction of movement of said drive wheel, a rod in threaded engagement with said member, and a stepping motor for selectively rotating said threaded rod.

2. The yarn feeder device as defined in claim 1 wherein said pressure roll peripheral surfaces contact said feeder roll peripheral surface at diametrically opposite points whereby yarns are driven in opposite directions.

3. The yarn feeder device as defined in claim 1 wherein said drive wheel has a peripheral edge engageable with a face of said drive disk, and said drive disk has an axis of rotation which is generally normal to said drive disk face.

4. The yarn feeder device as defined in claim 1 including means for braking the rotation of said drive shaft generally coincident with the cessation of rotation of said drive wheel by said drive disc.

5. The yarn feeder device as defined in claim 1 including means for braking the rotation of said drive shaft generally coincident with the cessation of rotation of said drive wheel by said drive disc, and said drive shaft braking means includes a brake arm movable into braking engagement with said drive shaft.

6. The yarn feeder device as defined in claim 1 including means for braking the rotation of said drive shaft generally coincident with the cessation of rotation of said drive wheel by said drive disc, and said drive shaft braking means includes a brake arm pivoted into braking engagement with said drive shaft.

7. The yarn feeder device as defined in claim 1 including means for braking the rotation of said drive shaft generally coincident with the cessation of rotation of said drive wheel by said drive disc, and said drive shaft braking means includes a brake arm biased into braking engagement with said drive shaft.

8. The yarn feeder device as defined in claim 1 including means for braking the rotation of said drive shaft generally coincident with the cessation of rotation of said drive wheel by said drive disc, and said drive shaft braking means includes a brake arm biased into braking engagement with said drive shaft and biased out of braking engagement with said drive shaft.

9. The yarn feeder device as defined in claim 1 including means for braking the rotation of said drive shaft generally coincident with the cessation of rotation of said drive wheel by said drive disc, and said drive shaft braking means includes a brake arm mechanically biased into braking engagement with said drive shaft and fluidically biased out of braking engagement with said drive shaft.

10. The yarn feed device as defined in claim 1 including spring means for biasing each of said pair of arms in a direction to urge said pressure roll peripheral surfaces against said feeder roll peripheral surface.

11. The yarn feeder device as defined in claim 1 including spring means for biasing each of said pair of arms in a direction to urge said pressure roll peripheral surfaces against said feeder roll peripheral surface, and means for selectively adjusting said spring means to vary the biasing force thereof.

12. The yarn feeder device as defined in claim 1 including means for rotating said drive disk, and means for selectively moving said drive disk into and out of engagement with said drive wheel to selectively rotate said drive shaft.

13. The yarn feeder device as claimed in claim 1 including means for rotating said drive disk, means for selectively moving said drive disk into and out of engagement with said drive wheel to selectively rotate said drive shaft, and said selectively moving means includes a bell crank lever.

14. The yarn feeder device as defined in claim 1 including means for rotating said drive disk, means for selectively moving said drive disk into and out of engagement with said drive wheel to selectively rotate said drive shaft, and said selectively moving means includes a biased bell crank lever.

15. The yarn feeder device as defined in claim 1 including means for rotating said drive disk, means for selectively moving said drive disk into and out of engagement with said drive wheel to selectively rotate said drive shaft, and said selectively moving means includes a fluidically biased bell crank lever.

16. The yarn feeder device as defined in claim 5 including spring means for biasing each of said pair of arms in a direction to urge said pressure roll peripheral surfaces against said feeder roll peripheral surface.

17. The yarn feeder device as defined in claim 5 including means for rotating said drive disk, and means for selectively moving said drive disk into and out of engagement with said drive wheel to selectively rotate said drive shaft.

18. The yarn feeder device as defined in claim 5 including means for rotating said drive disk, means for selectively moving said drive disk into and out of engagement with said drive wheel to selectively rotate said drive shaft, and said selectively moving means includes a bell crank lever.

19. The yarn feeder device as defined in claim 6 including spring means for biasing each of said pair of arms in a direction to urge said pressure roll peripheral surfaces against said feeder roll peripheral surface.

20. The yarn feeder device as claimed in claim 6 including means for rotating said drive disk, and means for selectively moving said drive disk into and out of engagement with said drive wheel to selectively rotate said drive shaft.

21. The yarn feeder device as defined in claim 6 including means for rotating said drive disk, means for selectively moving said drive disk into and out of engagement with said drive wheel to selectively rotate said drive shaft, and said selectively moving means includes a bell crank lever.

22. The yarn feeder device as defined in claim 8 including spring means for biasing each of said pair of arms in a direction to urge said pressure roll peripheral surfaces against said feeder roll peripheral surface.

23. The yarn feeder device as defined in claim 8 including means for rotating said drive disk, and means for selectively moving said drive disk into and out of engagement with said drive wheel to selectively rotate said drive shaft.

* * * * *